US011197511B2

(12) United States Patent
Keevy et al.

(10) Patent No.: US 11,197,511 B2
(45) Date of Patent: Dec. 14, 2021

(54) HELMET

(71) Applicant: LEATT CORPORATION, Santa Clarita, CA (US)

(72) Inventors: Pieter André Keevy, Durbanville (DE); Jörn Peter Steffens, Oldenburg (DE)

(73) Assignee: LEATT CORPORATION, Santa Clarita, CA (US)

( * ) Notice: Subject to any disclaimer, the term of this patent is extended or adjusted under 35 U.S.C. 154(b) by 114 days.

(21) Appl. No.: 16/460,606

(22) Filed: Jul. 2, 2019

(65) Prior Publication Data

US 2019/0343212 A1 Nov. 14, 2019

Related U.S. Application Data

(63) Continuation of application No. 15/312,271, filed as application No. PCT/IB2015/053735 on May 21, 2015, now abandoned.

(30) Foreign Application Priority Data

May 21, 2014 (GB) ..... 1409041

(51) Int. Cl.
*A42B 3/06* (2006.01)
*A42B 3/12* (2006.01)

(52) U.S. Cl.
CPC ..... *A42B 3/064* (2013.01); *A42B 3/127* (2013.01)

(58) Field of Classification Search
CPC ..... A42B 3/064; A42B 3/127; A42B 3/063; A42B 3/062; A42B 3/06; A42B 3/10; A42B 3/125; A42B 3/128; A42B 3/12
USPC ..... 2/410, 411, 412, 413, 414, 6.8
See application file for complete search history.

(56) References Cited

U.S. PATENT DOCUMENTS

| | | | |
|---|---|---|---|
| 5,204,998 | A | 4/1993 | Liu |
| 8,316,512 | B2 | 11/2012 | Halldin |
| 8,578,520 | B2 | 11/2013 | Halldin |
| 8,955,169 | B2 | 2/2015 | Weber et al. |
| 9,375,041 | B2 | 6/2016 | Plant |
| 9,603,406 | B2 | 3/2017 | Halldin |
| 9,820,525 | B2 | 11/2017 | Weber et al. |
| 9,955,745 | B2 | 5/2018 | Halldin |
| 10,212,979 | B2 | 2/2019 | Halldin |
| 10,408,294 | B2 | 9/2019 | Plant |
| 10,874,160 | B2 | 12/2020 | Halldin |
| 10,980,306 | B2 | 4/2021 | Weber et al. |
| 2010/0115686 | A1 | 5/2010 | Halldin |
| 2012/0021167 | A1 | 1/2012 | Plant |

(Continued)

FOREIGN PATENT DOCUMENTS

| | | |
|---|---|---|
| GB | 1059052 | 2/1967 |

*Primary Examiner* — F Griffin Hall
(74) *Attorney, Agent, or Firm* — Stephen J. Weyer, Esq.; Stites & Harbison, PLLC

(57) ABSTRACT

A helmet comprises an outer shell, an impact absorbing liner inside the outer shell to receive loads from the outer shell and an inner liner disposed inside the impact absorbing liner, with the inner liner configured to slide relative to the impact absorbing liner. The inner liner defines a number of apertures and a deflector inside each aperture. Each deflector comprises: a body that is connectable to the impact absorbing liner; a peripheral border that is connectable to the aperture in which it is received; and a number of deformable spokes extending between the body and the border.

17 Claims, 4 Drawing Sheets

(56) References Cited

U.S. PATENT DOCUMENTS

| | | | | |
|---|---|---|---|---|
| 2012/0198604 | A1 | 8/2012 | Weber et al. | |
| 2013/0042397 | A1 | 2/2013 | Halldin | |
| 2014/0096311 | A1 | 4/2014 | Halldin | |
| 2015/0157082 | A1 | 6/2015 | Weber et al. | |
| 2016/0073723 | A1* | 3/2016 | Halldin ..... | A42B 3/06 2/411 |
| 2016/0113347 | A1 | 4/2016 | Halldin | |
| 2016/0245358 | A1 | 8/2016 | Plant | |
| 2016/0316845 | A1 | 11/2016 | Halldin | |
| 2017/0231312 | A1 | 8/2017 | Halldin | |
| 2018/0070667 | A1 | 3/2018 | Weber et al. | |
| 2019/0116908 | A1 | 4/2019 | Halldin | |
| 2020/0040958 | A1 | 2/2020 | Plant | |
| 2020/0397086 | A9 | 12/2020 | Halldin | |
| 2021/0076768 | A1 | 3/2021 | Halldin | |

* cited by examiner

HELMET

CROSS-REFERENCE TO RELATED APPLICATION

This application is a continuation of U.S. patent application Ser. No. 15/312,271, filed Nov. 18, 2016, which is a 371 of PCT/IB2015/053735 filed May 21, 2015, all herein incorporated by reference.

FIELD OF THE INVENTION

This invention relates to protective helmets intended to protect the head against linear and rotational impacts.

BACKGROUND TO THE INVENTION

Most protective helmets comprise a durable, hard outer shell that can receive impacts and an energy absorbing liner that is intended to dissipate energy from an impact received on the outer shell, before transferring it to the wearer's head. These conventional helmets provide reasonably good protection against impacts that could result in linear cranial acceleration, but impacts that are poorly aligned with the centre of gravity of the wearer's head (that often impact the helmet at an oblique angle) can still result in substantial rotational cranial acceleration and consequential brain injury and concussion. Further, the impacts may be severe or they may be moderate and repetitive and the injuries resulting from repetitive brain injury often go unnoticed initially, until their cumulative effect is severe. Also, while conventional helmets provide reasonably good protection against severe linear impacts, they are typically not designed to protect the head against moderate (e.g. low speed) impacts, which could cause brain injury from a single instance or through repetition.

Helmets that are intended to protect a wearer against linear and rotational cranial acceleration have been proposed in US 2012/0198604, including a relatively hard outer shell, an outer liner inside the outer shell and an inner liner, spaced inside the outer liner, with various resilient elastomeric isolation dampers extending between the inner and outer liners, to absorb omnidirectional loads between the two liners.

The present invention seeks to provide an improved helmet which protects a wearer's head against linear and rotational impacts, including improved protection against linear, low speed impacts.

SUMMARY OF THE INVENTION

According to the present invention there is provided a helmet comprising:

an outer shell;

an impact absorbing liner disposed inside the outer shell and connected in a load transferring manner to the outer shell to receive loads from the outer shell;

an inner liner disposed inside the impact absorbing liner, said inner liner being configured to slide relative to the impact absorbing liner and said inner liner defining at least one receiving formation, but preferably plurality of apertures; and at least one deflector comprising: a body that is connectable to the impact absorbing liner; a border along at least part of the deflector's periphery, said border being connectable to one of the receiving formations of the inner liner; and at least one deformable element extending between the body and the border.

The term "connected" is intended to include any arrangement in which the impact absorbing liner can receive loads from the outer shell and it is not limited to contact, attachment, linkage, or any other limitation.

The term "aperture" is intended to include any form of recess in the inner liner, in which a deflector is receivable, at least in part.

One or more (preferably all) of the receiving formations may be apertures defined in the inner liner and one or more (preferably all) of the deflectors may be connectable to the apertures by fitting inside the apertures The deformable elements may include a plurality of deformable spokes extending between the body and the border and at least some of the spokes may be curved and/or may extend in a spiral configuration between the body and the border.

At least some of the deflectors may be of a non-Newtonian material preferably a shear thickening or dilatant material.

At least some of the deflectors may define a shell extending between the impact absorbing liner and the inner liner and the shell may be at least partly collapsible and may extend at least partly around a cavity defined in the deflector.

The bodies of at least some of the deflectors may be releasably connectable to the impact absorbing liner and/or may be connectable to the impact absorbing liner by way of anchor formations that extend, at least in part, into the impact absorbing liner.

BRIEF DESCRIPTION OF THE DRAWINGS

For a better understanding of the present invention, and to show how it may be carried into effect, the invention will now be described by way of non-limiting example, with reference to the accompanying drawings in which.

DETAILED DESCRIPTION OF THE DRAWINGS

Figure 1:
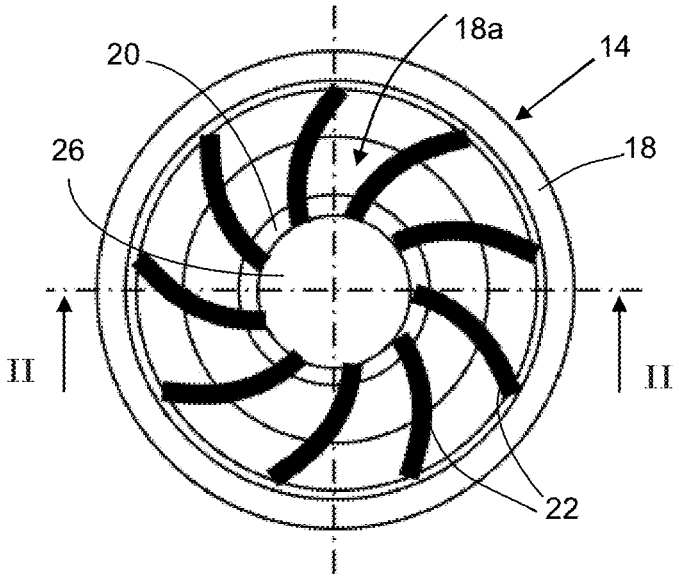
FIG. 1 is an inside view of a deflector according to the present invention.

Referring to the drawings, a helmet according to the present invention includes: an outer shell of tough, durable material (not shown); an impact absorbing liner generally designated by reference number 10 and having an impact absorbing liner inner surface 10*a* and impact absorbing liner outer surface 10*b*, an inner liner, which in the illustrated example it is a comfort liner, generally designated by reference number 12 and having a comfort liner inner surface 12*a* and a compact liner outer surface 12*b*; and a plurality of deflectors, generally designated by reference number 14, with suffixes to distinguish between different deflectors, where relevant. It is possible for the helmet to have any number of deflectors 14—even only one, but preferably, the helmet includes a plurality of spaced deflectors.

The impact absorbing liner 10 can be of any suitable material that can absorb impact energy, such as expanded polystyrene (EPS) and it extends directly inside the outer shell. The impact absorbing liner 10 can be attached to the outer shell (e.g. with releasable attachment), it can be held in place by complementary geometries of these components, or it can be held in place inside the outer shell in any other way, but it is preferably attached to the inside of the outer shell by being moulded inside the outer shell. The outer shell and impact absorbing liner 10 are configured so that the energy from impacts received on the outer shell are dissipated in part, in the impact absorbing liner, before the impact is transferred to the head of a wearer of the helmet—much as in conventional helmets.

The comfort liner 12 extends along and in contact with the inside of the impact absorbing liner 10, with comfort liner outer surface 12*b* in contact with impact absorbing liner inner surface 10*a*, preferably in direct contact, but the two liners 10, 12 are not attached to each other and can slide relative to each other. Instead of the comfort liner 12, in other embodiments of the invention, the inner liner can be of any material, but the comfort liner 12 is of soft compressible material, such as soft foam that is soft enough to fit comfortably on the wearer's head. In a preferred embodiment, relative sliding motion between the impact absorbing liner 10 and comfort liner 12 is improved by choice of materials, slip washers provided between these components, or the like.

The comfort liner 12 includes one or more receiving formations for connecting to the deflectors and in the illustrated embodiment, the receiving formations are in the form of apertures 16 that are defined in the comfort liner 12 and in the preferred embodiment, each of the apertures has a circular profile and extends through the comfort liner, with a diameter similar to the outer diameter of a deflector 14. In other embodiments, the apertures defined in the inner liners can be in the form of recesses that do not extend through the comfort liner, or the comfort liner could include other forms of receiving formations such as protuberances, grip formations, adhesive or gripping material, or the like.

Figure 2:
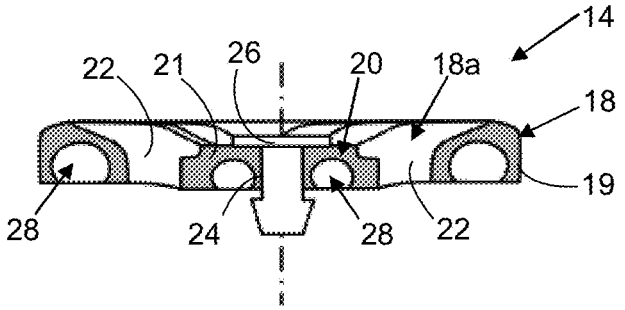
FIG. 2 is a sectional side view of the deflector of FIG. 1, taken at II-II.
Figure 3:
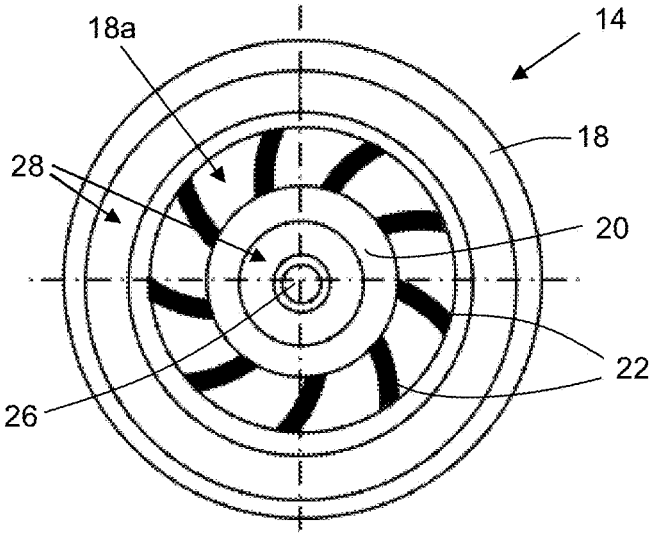
FIG. 3 is an outside view of the deflector of FIG. 1.

Referring in particular to FIGS. 1-3, in a first preferred embodiment, each deflector 14 is generally disc shaped and is a unitary injection moulding of a non-Newtonian, shear thickening (dilatant) material.

Each deflector 14 has a central body in the form of a hub 20 and a border 18 extending around its circumference, the border 18 thus defining hole 18*a* within which the hub is positioned, with a number of deformable elements in the form of curved spokes 22 extending between the hub 20 and the border 18 in a spiral configuration. In the illustrated embodiment, each of the spokes 22 has an elongated cross-sectional profile and can flex with relative ease if the hub 20 moves relative to the border 18. In other embodiments of the invention can include differently configured deformable elements instead or, or in addition to the spokes 22, which also extend flexibly between the body and the border.

A central passage 24 is defined in the hub 20, through which an anchor formation in the form of a pin 26 can pass.

In the illustrated embodiment, the hub 20 and border 18 are each of a hollow design, comprising partly collapsible shells 19,21 around open internal cavities 28, which allow the hub and border to be compressed, when the shells collapse to any degree. When the hub 20 and border 18 are compressed, the spokes 22 also flex or twist, so that the whole deflector 14 is compressible. The shear-thickening properties of the material from which the deflector 14 is made, allows it to be compressed with relative ease when not exposed to impacts (e.g. during normal use of the helmet), but if it receives a compression impact, e.g. from a linear impact exerted on the outer shell of the helmet, the deflector offers more resistance to compression. The hollow (U-shaped) profile of the shells 19,21 of the hub 20 and border 18 allows these features to collapse under pressure and expand sideways, which allows the spokes 22 more freedom to stretch and allow movement between the hub and border.

Figure 4:
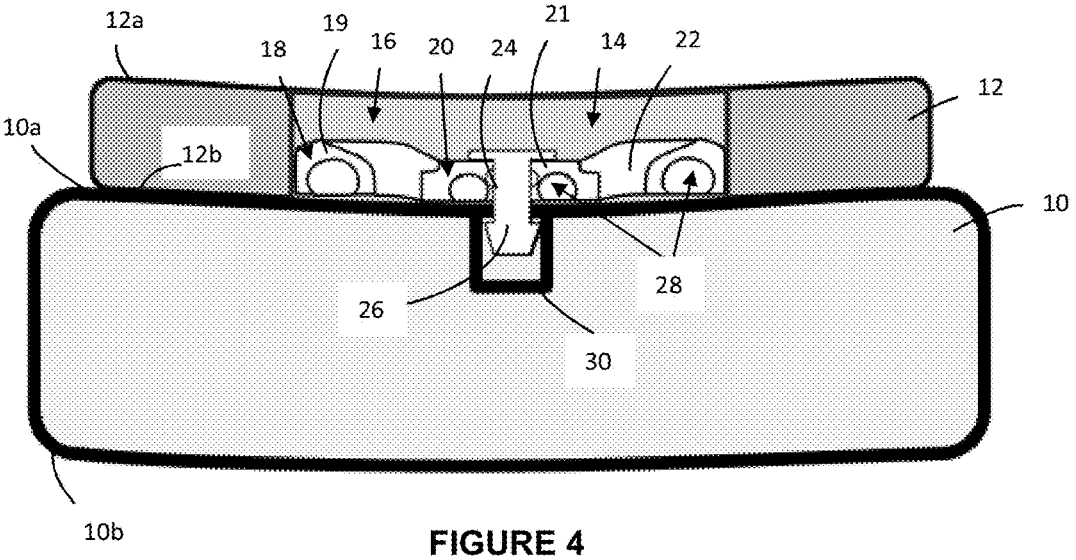
FIG. 4 is a detail sectional view through part of an impact absorbing liner, part of an inner liner, and the deflector of FIG. 1.

Referring to FIG. 4, each deflector 14 is attached to the impact absorbing liner 10 by the pin 26 that is received in a recess inside the impact absorbing liner. Preferably, the recess in the impact absorbing liner 10 is lined with a basket 30 in which the end of the pin 26 is receivable in a clipping manner—holding the deflector firmly 14 in place, but allowing it to be removed and/or replaced, if necessary. In other embodiments, an attachment formation similar to the pin 26 may be integrally formed with the deflector 14 or the deflector may be attached to the impact absorbing liner 10 by other means, such as partially embedding it in the impact absorbing liner during moulding (of the impact absorbing liner).

The border 18 of the deflector 14 fits snugly inside the circumference of the aperture 16 and in the illustrated embodiment has a thickness that is substantially less than the thickness of the comfort liner 12. In one embodiment, the deflector 14 has a thickness of about 5 mm and a diameter of about 26 mm.

Various configurations of the comfort liner 12 and deflectors 14 are possible in other embodiments of the invention. For example, the comfort liner 12 could define open apertures in which the deflectors 14 are received (as in the illustrated embodiment), with the deflectors exposed, the deflectors could be flush or protrude on the inside of the comfort liner (if this does not create discomfort), or the comfort liner could receive the deflectors in blind recesses and cover the deflectors on the inside of the helmet. In other embodiments of the invention, the deflectors 14 could connect the comfort liner 12 with the impact absorbing liner 10; the deflectors could replace the comfort liner; the deflectors could be integrated (e.g. injected) into the comfort liner; or the deflectors could be in-layered (during the in-moulding process) in the impact absorbing liner.

Figure 5A:
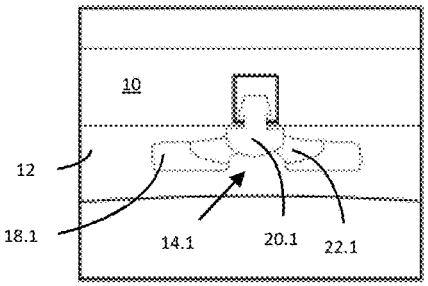
FIGS. 5A to 5C shows diagrammatic sectional views and FIGS. 5D to 5F show diagrammatic outside views of part of an impact absorbing liner and a deflector according to the present invention, FIGS. 5A and 5D showing the deflector before impact, and FIGS. 5B and 5E and FIGS. 5C and 5F, respectively, showing the deflector while receiving tangential impact loads from opposing directions.
Figure 5B:
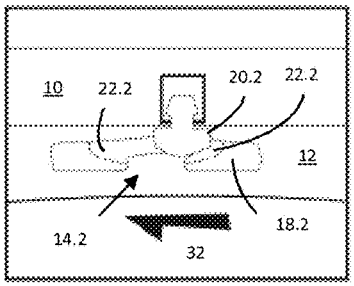
Figure 5C:
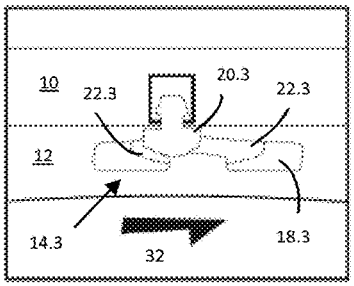
Figure 5D:
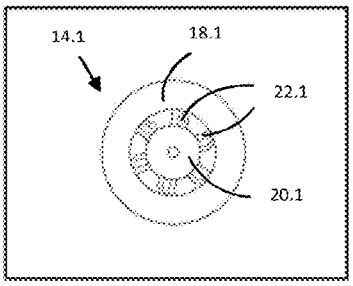
Figure 5E:
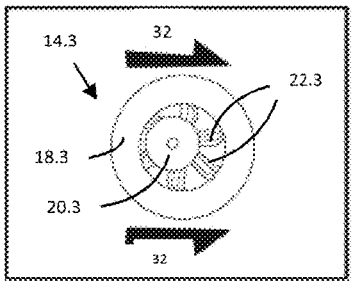
Figure 5F:
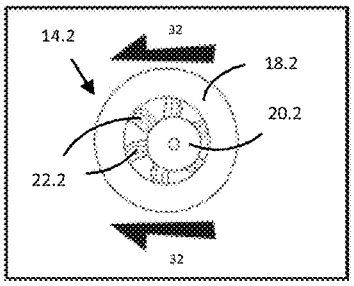

Referring to FIGS. 5A to 5C: sectional views of three deflectors are shown, numbered as 14.1, 14.2 and 14.3, each anchored in the impact absorbing liner 10 and received in the comfort liner 12. FIGS. 5D to 5F show outside views of the deflectors of FIGS. 5A to 5C. The deflector 14.1 shown in FIG. 5A and FIG. 5D, has not been subjected to any force and is in its original shape, but the deflectors 14.2 shown in FIG. 5B and FIG. 5F and deflectors 14.3 shown in FIG. 5C and FIG. 5E, have been subjected to forces 32 in tangential directions. The tangential forces 32 caused the borders 18.2 and 18.3 of the deflectors 14.2 and 14.3 to be displaced relative to their hubs 20.2 and 20.3 and caused their spokes 22.2 and 22.3 to be deflected by the relative displacement of the borders.

The deflection of the spokes 22 and the relative displacement of the border 18 relative to the hub 20 results partly from the geometry of the deflector 14 (particularly the spokes) and partly from the resilient deformability of the non-Newtonian material of the deflector 14.2.

Figure 6:
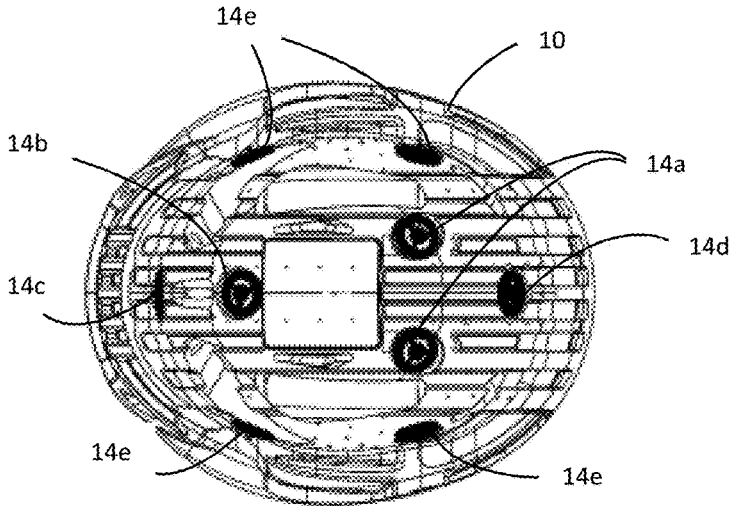
FIG. 6 shows a bottom view of an impact absorbing liner and deflectors according to the present invention, including deflectors hidden by part of the impact absorbing liner.
Figure 7:
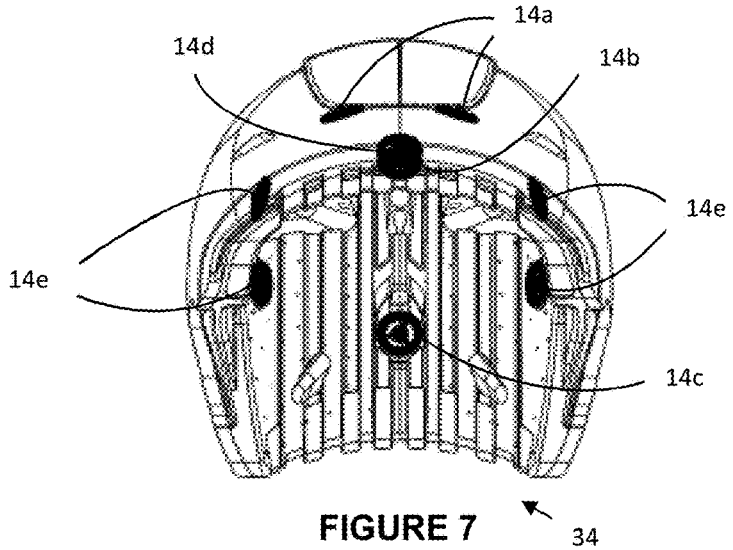
FIG. 7 shows a front view of the impact absorbing liner and deflectors of FIG. 6, including deflectors hidden by part of the impact absorbing liner.
Figure 8:
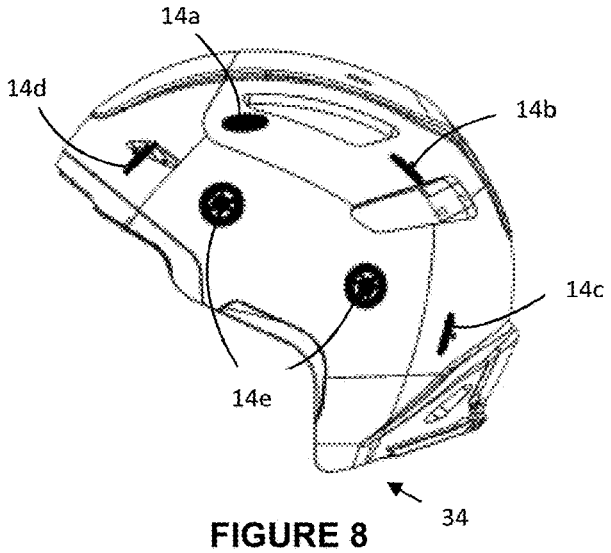
FIG. 8 shows a side view of the impact absorbing liner of FIG. 6, with deflectors of the lower ring.

Referring to FIGS. 6 to 8, the positions of the deflectors 14 relative to the impact absorbing layer 10 are shown and include three deflectors in an upper ring and six deflectors in a lower ring, disposed on an imaginary profile resembling the profile of a human head. The deflectors 14 in the upper ring include two front deflectors 14*a* and a rear deflector 14*b*. The deflectors in the lower ring includes a rear deflector 14*c*, of a lower ring of deflectors, with the deflector 14*c* disposed about midway between the deflector 14*b* and the base 34 of the impact absorbing liner 10. The other deflectors in the lower ring include a front deflector 14*d* and two lateral deflectors 14*e* on each side of the helmet. The positioning of the deflectors 14 is intended to provide an even distribution of rotational/tangential forces transferred between the impact absorbing liner 10 and comfort liner 12 by the deflectors 14, as will be described below. However, this distribution of the deflectors 14 is only one example and in other embodiments of the invention, more or fewer deflectors can be used and they can be distributed in various other configurations.

Figure 9:
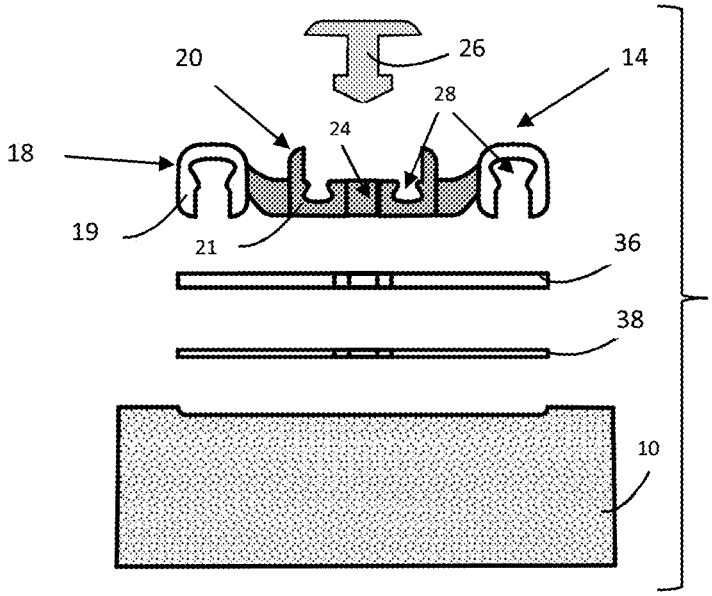
FIG. 9 shows an exploded sectional side view of a kit for installing a deflector on an impact absorbing liner according to the present invention.
Figure 10:
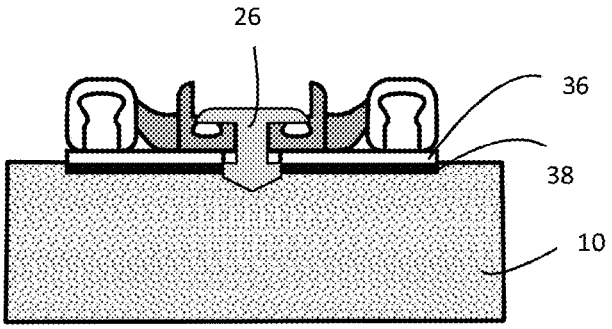
FIG. 10 shows a sectional view of the deflector of FIG. 9 installed on the impact absorbing liner.
Figure 11:
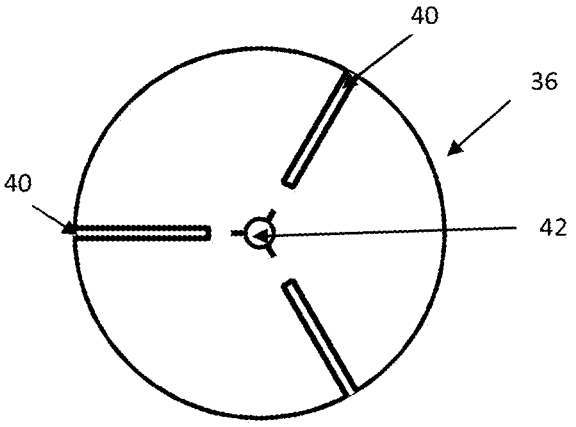
FIG. 11 shows a profile view of a mounting washer of the kit of FIG. 9.

Referring to FIGS. 9 to 11, instead of the helmet being manufactured originally according to the embodiments of the invention described above, the invention extends to a kit that can be used to modify a helmet by fitting deflectors 14 to the impact absorbing liner 10 of the helmet. (Rigorous safety standards are applied to the design and manufacture of helmets in most countries and modification of helmets is not necessarily advisable or permitted, so care needs to be taken when considering modification of a helmet.)

The kit includes one or more deflectors 14 as described above, a rough washer 36, an adhesive layer 38 for attaching the washer to the inside of the impact absorbing liner 10 and a pin 26 for securing the deflector. The adhesive layer 38 is typically applied to the washer 36 (even though they are shown separately in FIG. 9) and the washer is attached to the impact absorbing liner 10 in a preferred position. The washer 36 preferably includes radial grooves 40 that allow it to be shaped to fit on a concave surface. The deflector 14 is fitted by passing the pin 26 through the central passage 24 of the deflector and clipping an end of the pin into an aperture 42 defined in the washer 36.

The border 18 and hub 20 of the deflector 14 shown in FIGS. 9 and 10 have different profiles from those shown in preceding figures, but they still each define a collapsible shell 19,21 and cavity 28 so that they are compressible, as described above.

Referring to all the drawings, in use, if severe linear impacts are received on the outer shell of the helmet, i.e. impacts that are aligned with the centre of gravity of the wearer's head and helmet, and where the impact thus results primarily in linear compression, without significant rotational forces, the impacts are dissipated in the impact absorbing liner 10 before being transferred to the wearer's head, by compression of the impact absorbing liner—generally as occurs in conventional helmets.

If moderate linear impacts are received, e.g. linear impacts at low speeds, the energy from the impact will be transferred through the impact absorbing liner 10 and the comfort liner 12 will readily compress without dissipating much of the impact energy, but the deflectors 14 will be compressed between the impact absorbing liner 10 and the wearer's head and a substantial part of the impact energy will be absorbed by the compression of the deflectors 14.

If the impact forces are very low (probably too low to cause injury), they may be adequately dissipated in the comfort liner 12 and if they are severe, they may be adequately dissipated in the impact absorbing liner 10, but the present invention also protects the wearer against moderate impacts, with impact absorption in the deflectors that varies with the severity of the impact, due to the non-Newtonian properties of the material from which the deflectors 14 are made.

If rotational impacts are received on the outer shell of the helmet, i.e. impacts that are not aligned with the centre of gravity of the wearer's head and helmet, and that thus result in rotational forces, the rotational forces are transferred as tangential forces 32 from the impact absorbing liner 10 to the comfort liner, via the deflectors 14.

In the event that a rotational/tangential force 32 is transferred from the impact absorbing liner 10 to the comfort liner 12, the spokes 22 deflect and the border 18 and hub 20 are displaced relative to each other, as shown in FIG. 5, but the relative position of the comfort liner 12 relative to the impact absorbing liner is determined by the position of the border 18, so that the deflection of the spokes allows relative displacement between the impact absorbing liner and the comfort liner.

The resilience of the spokes 22 when they deflect, causes some of the impact of the rotational/tangential force 32 to be dissipated before it is transferred from the impact absorbing layer 10 to the comfort liner 12 and accordingly, the rotational impact is reduced before it is transferred to the wearer's head. The deflection of the spokes 22 is also reversible in the case of moderate impacts and accordingly, the deflectors 14 can protect the wearer's head against repeated moderate rotational impacts.

The invention has been described with reference to the impact absorbing liner 10 and comfort liner 12, but the liner 10 need not form the only impact absorbing layer and can be a liner inside another impact absorbing liner and likewise, the liner 12 need not be the only comfort liner and can have an additional liner on its inside. The liners 10 and/or 12 can thus replace the impact absorbing liner and comfort liner of conventional helmet construction, wholly or in part.

The invention claimed is:

1. A helmet comprising:

an outer shell;

an impact absorbing liner disposed inside the outer shell and connected in a load transferring manner to the outer shell to receive loads from the outer shell; and at least one deflector comprising:

a central body connected in a load transferring manner to an inside of the impact absorbing liner and extending from the inside of the impact absorbing liner by a first distance;

a border extending around the central body and being spaced from the central body, said border having a thickness which causes it to extend from the inside of the impact absorbing liner by a second distance, said second distance being generally equal to the first distance by which the central body extends from the inside of the impact absorbing liner;

at least one flexible element extending between and fixedly connected to the border and the central body; and an inner liner that extends at least partly around the border and which is configured to transfer loads to the border in tangential directions;

in which the inner liner defines a receiving formation in which the border is received.

2. The helmet according to claim 1, wherein the at least one flexible element includes a plurality of deformable spokes extending between the central body and the border.

3. The helmet according to claim 2, wherein at least some of the spokes are curved.

4. The helmet according to claim 3, wherein at least some of the spokes extend in a spiral configuration between the central body and the border.

5. A helmet comprising:

an outer shell;

an impact absorbing liner disposed inside the outer shell and connected in a load transferring manner to the outer shell to receive loads from the outer shell; and at least one deflector comprising:

a central body connected in a load transferring manner to an inside of the impact absorbing liner and extending from the inside of the impact absorbing liner by a first distance;

a border extending around the central body and being spaced from the central body, said border having a thickness which causes it to extend from the inside of the impact absorbing liner by a second distance, said second distance being similar to the first distance by which the central body extends from the inside of the impact absorbing liner, said border defining a hollow, compressible shell with an inner cavity extending along the border; and at least one flexible element extending between and fixedly connected to the border and the central body;

wherein the border has a U-shaped profile that is open towards the impact absorbing liner.

6. The helmet according to claim 5, wherein the second distance differs from the first distance by less than 50%.

7. The helmet according to claim 6, wherein the first distance is generally equal to the second distance.

8. The helmet according to claim 7, which includes an inner liner that extends at least partly around the border and which is configured to transfer loads to the border in tangential directions.

9. The helmet according to claim 8, in which the inner liner defines a receiving formation in which the border is received.

10. The helmet according to claim 6, wherein the border defines a hollow, compressible shell with an inner cavity extending along the border.

11. The helmet according to claim 10, wherein the border has a U-shaped profile that is open towards the impact absorbing liner.

12. The helmet according to claim 6, wherein the at least one flexible element includes a plurality of deformable spokes extending between the central body and the border.

13. The helmet according to claim 12, wherein at least some of the spokes are curved.

14. The helmet according to claim 13, wherein at least some of the spokes extend in a spiral configuration between the central body and the border.

15. A helmet comprising:

an outer shell;

an impact absorbing liner disposed inside the outer shell, the impact absorbing liner having an outer surface positioned along the outer shell and an inner surface opposite the outer surface;

an inner liner disposed inside the impact absorbing liner, the inner liner having an outer surface positioned along the inner surface of the impact absorbing liner and an inner surface opposite the outer surface, the inner liner defining at least one aperture extending from the inner surface of the inner liner and towards the outer surface of the inner liner; and a deflector positioned within the aperture of the inner liner adjacent to the inner surface of the impact absorbing liner, the deflector comprising:

a border which contacts the aperture of the inner liner along an outer perimeter of the border, the border defining a hole that extends through the border;

a central body positioned within the hole of the border, the central body connected to the impact absorbing liner; and at least one flexible element extending radially from the central body to the border.

16. The helmet of claim 15, wherein the impact absorbing liner defines a basket extending from the inner surface of the impact absorbing liner towards the outer surface of the impact absorbing liner; and wherein a pin is inserted through the central body of the deflector and into the cavity of the impact absorbing liner to removably clip to the impact absorbing liner.

17. The helmet of claim 15, wherein the deflector has a thickness substantially less than a thickness of the inner liner.

* * * * *